US012606981B2

(12) United States Patent
Noda

(10) Patent No.: US 12,606,981 B2
(45) Date of Patent: Apr. 21, 2026

(54) LOAD DISCHARGE SYSTEM

(71) Applicant: KOBELCO CONSTRUCTION MACHINERY CO., LTD., Hiroshima (JP)

(72) Inventor: Daisuke Noda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 36 days.

(21) Appl. No.: 18/702,469

(22) PCT Filed: Sep. 30, 2022

(86) PCT No.: PCT/JP2022/036632
§ 371 (c)(1),
(2) Date: Apr. 18, 2024

(87) PCT Pub. No.: WO2023/079869
PCT Pub. Date: May 11, 2023

(65) Prior Publication Data

US 2024/0410128 A1 Dec. 12, 2024

(30) Foreign Application Priority Data

Nov. 2, 2021 (JP) ..... 2021-179513

(51) Int. Cl.
*E02F 3/43* (2006.01)
*E02F 9/26* (2006.01)
*E02F 9/20* (2006.01)

(52) U.S. Cl.
CPC ..... *E02F 3/439* (2013.01); *E02F 9/265* (2013.01); *E02F 9/2025* (2013.01)

(58) Field of Classification Search
CPC ... E02F 9/265; E02F 3/43; E02F 3/437; E02F 9/2029; E02F 9/262; E02F 3/439; E02F 9/2025
(Continued)

(56) References Cited

U.S. PATENT DOCUMENTS 5,356,259 A * 10/1994 Hanamoto ..... E02F 3/438 37/348
5,768,810 A * 6/1998 Ahn ..... E02F 3/436 701/50
(Continued)

FOREIGN PATENT DOCUMENTS

CN 1262716 A * 8/2000 ..... E02F 9/26
CN 113944197 A * 1/2022 ..... E02F 3/437
(Continued)

OTHER PUBLICATIONS

Thombarer, Akash V., et al. "Shape optimization of an excavator bucket with the help of ANSYS software." International Research Journal of Engineering and Technology (IRJET) 8.03 (2021). (Year: 2021).*
(Continued)

*Primary Examiner* — Cuong H Nguyen
(74) *Attorney, Agent, or Firm* — Oblon, McClelland, Maier & Neustadt, L.L.P.

(57) ABSTRACT

A load discharge system for loading work in which a discharge operation of discharging a load in a bucket of a work machine into a container is repeatedly performed. The load discharge system includes a controller for controlling the operation of the work machine, the controller acquires information on an amount of load in the bucket of the work machine and acquires information on a position of the container. The controller calculates a target discharge position that is a target position for the discharge operation using
(Continued)

the information on the position of the container and the information on the amount of load in the bucket.

7 Claims, 5 Drawing Sheets

(58) Field of Classification Search
USPC ..... 701/50
See application file for complete search history.

(56) References Cited

U.S. PATENT DOCUMENTS

| | | | | |
|---|---|---|---|---|
| 9,677,251 | B2 * | 6/2017 | Kitajima | E02F 3/3677 |
| 10,975,545 | B2 * | 4/2021 | Matsuyama | E02F 3/435 |
| 11,408,146 | B2 * | 8/2022 | Nishimura | E02F 9/2246 |
| 2012/0130599 | A1 * | 5/2012 | Faivre | E02F 9/265 701/50 |
| 2018/0119384 | A1 * | 5/2018 | Imaizumi | E02F 9/265 |
| 2019/0177948 | A1 * | 6/2019 | Matsuyama | E02F 3/437 |
| 2022/0195690 | A1 | 6/2022 | Wu et al. | |

FOREIGN PATENT DOCUMENTS

| | | | | |
|---|---|---|---|---|
| CN | 109983182 B | * | 2/2022 | E02F 3/431 |
| CN | 111042245 B | * | 4/2022 | E02F 3/437 |
| CN | 111771030 B | * | 4/2022 | E02F 9/264 |
| EP | 3779068 A1 | * | 2/2021 | E02F 9/261 |
| JP | 11-124880 A | | 5/1999 | |
| JP | WO2012127912 A1 | * | 7/2014 | E02F 9/2025 |
| KR | 102590162 B1 | * | 10/2023 | E02F 3/43 |
| WO | WO-2013191017 A1 | * | 12/2013 | E02F 9/265 |
| WO | WO-2015129932 A1 | * | 9/2015 | E02F 9/0841 |
| WO | WO 2017/126182 A1 | | 7/2017 | |
| WO | WO-2019049248 A1 | * | 3/2019 | E02F 9/2203 |
| WO | WO 2021/054436 A1 | | 3/2021 | |
| WO | WO-2021230635 A1 | * | 11/2021 | G01C 15/002 |

OTHER PUBLICATIONS

Casoli, Paolo, et al. "Comparative energy analysis of a load sensing system and a zonal hydraulics for a 9-tonne excavator." Actuators. vol. 9. No. 2. MDPI, 2020. (Year: 2020).*

Svanberg, Andreas, et al. "Full-scale simulation and validation of bucket filling for a mining rope shovel by using a combined rigid FE-DEM granular material model." Computational Particle Mechanics 8.4 (2021): 825-843. (Year: 2021).*

Liu, Wenting, et al. "Lifetime reliability of hydraulic excavators' actuator." IEEE Access 11 (2023): 117670-117684. (Year: 2023).*

International Search Report issued Nov. 1, 2022, in PCT/JP2022/036632, filed on Sep. 30, 2022, 2 pages.

* cited by examiner

LOAD DISCHARGE SYSTEM

TECHNICAL FIELD

The present invention relates to a load discharge system used for loading work of discharging a load from a bucket of a work machine into a container and loading the load into the container.

BACKGROUND ART

For example, Patent Literature 1 discloses an excavator for discharging a load from a bucket by automatic operation of a work machine. In the excavator described in Patent Literature 1, an excavated object (load) is discharged from a bucket by changing an angle of the bucket while the bucket is moved in a longitudinal direction of a cargo bed of a dump truck (see FIG. 7A of Patent Literature 1). A control device of the excavator recognizes the position of the dump truck and generates a target trajectory of a soil discharging operation. The target trajectory is set such that a height of a loaded object newly formed by the excavated object becomes substantially constant when the excavated object taken in the bucket is dumped to the cargo bed of the dump truck.

However, in the excavator described in Patent Literature 1, in order to load the excavated object (load) onto the cargo bed (container) such that the height of the loaded object becomes substantially constant, the angle of the bucket is required to be finely adjusted, and it is difficult to control the bucket. Therefore, there is a possibility that the load after a loading work from the bucket into the container is completed has a shape with large irregularities.

CITATION LIST

Patent Literature

Patent Literature 1: WO 2021/054436 A

SUMMARY OF INVENTION

An object of the present invention is to provide a load discharge system capable of reducing variations in height of a load to be loaded into a container in a loading work in which a discharge operation of discharging the load in a bucket of a work machine into the container is repeatedly performed.

There is provided a load discharge system used for a loading work in which a discharge operation of discharging a load in a bucket of a work machine into a container is repeatedly performed, the load discharge system including a controller that controls an operation of the work machine, in which the controller acquires information on an amount of the load in the bucket of the work machine, acquires information on a position of the container, and calculates a target discharge position that is a target position for the discharge operation by using the information on the position of the container and the information on the amount of the load in the bucket.

DESCRIPTION OF EMBODIMENTS

A load discharge system 1 according to an embodiment of the present invention will be described with reference to FIGS. 1 to 5.

Figure 1:
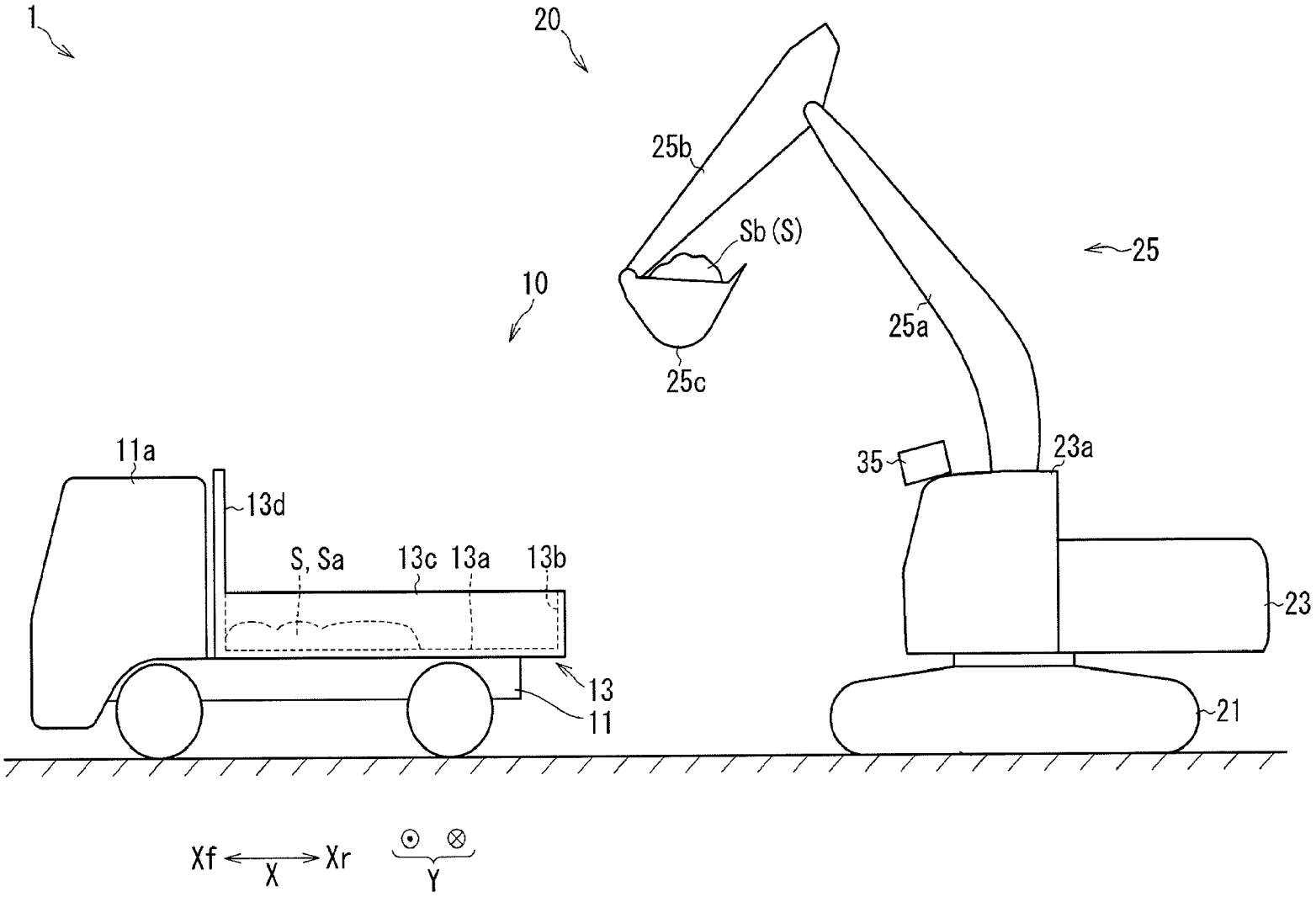
FIG. 1 is a side view of a vehicle and a work machine of a load discharge system according to an embodiment of the present invention, and illustrates an example of arrangement of the vehicle and the work machine.

The load discharge system 1 illustrated in FIG. 1 is used for loading work in which a discharge operation of discharging a load S in a bucket 25*c* of a work machine 20 into a container 13 is repeatedly performed. The discharge operation is an operation performed by the work machine 20. The work machine 20 performs the discharge operation a plurality of times in the loading work.

The load discharge system 1 includes a controller 50 for controlling the operation of the work machine 20. The controller 50 calculates a target discharge position Xt (see FIG. 5) that is a target position for the discharge operation. Specifically, the controller 50 acquires information on the amount of an in-bucket load Sb that is a load in the bucket 25*c* of the work machine 20, acquires information on the position of the container 13, and calculates the target discharge position Xt for the discharge operation by using the information on the position of the container 13 and the information on the amount of the in-bucket load Sb.

Figure 5:
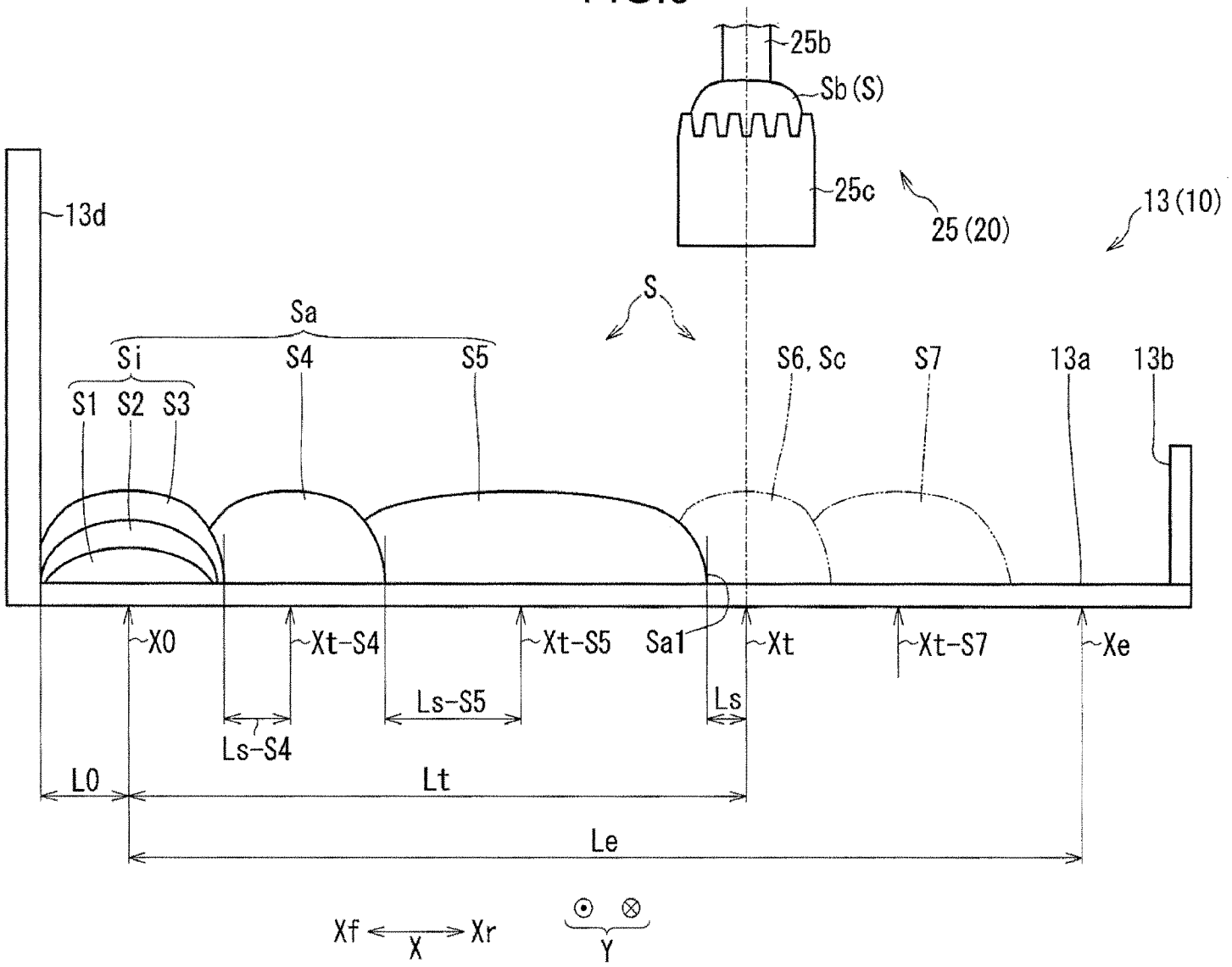
FIG. 5 is a side view of a container of the vehicle and a load.

As illustrated in FIG. 5, the load discharge system 1 can reduce variations in height of the load S (loads S1 to S7) loaded into the container 13 in the loading work. The height of the load S in the container 13 is a height from a bottom surface 13*a* of the container 13. The load S can be accommodated in the bucket 25*c* and can be loaded from the bucket 25*c* into the container 13. The load S is, for example, an earthy, granular, chip-like, powdery, massive, or the like. Specifically, for example, the load S may be earth and sand, stone, wood, metal, or waste.

Figure 3:
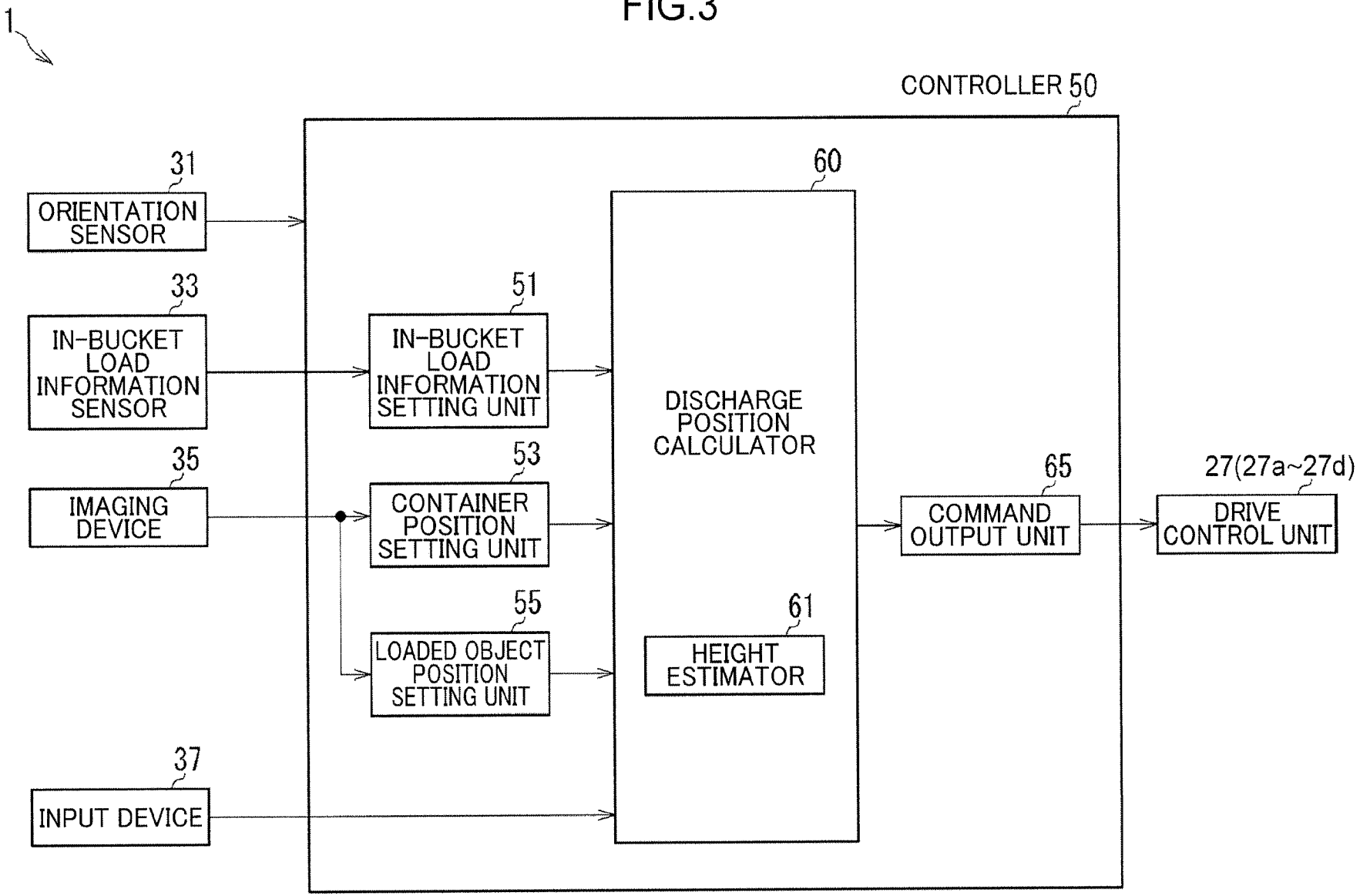
FIG. 3 is a block diagram illustrating a configuration of the load discharge system.

The load discharge system 1 includes a vehicle 10 illustrated in FIG. 1, the work machine 20, an orientation sensor 31 illustrated in FIG. 3, an in-bucket load information sensor 33, an imaging device 35, an input device 37, and the controller 50.

As illustrated in FIG. 1, the vehicle 10 includes a vehicle body 11 and the container 13. The vehicle 10 is a machine such as a conveyor vehicle or a transport vehicle that carries the load S loaded into the container 13. The vehicle 10 may be, for example, a dump truck.

The vehicle body 11 supports the container 13. The vehicle body 11 includes a vehicle cab 11*a* and a traveling device for traveling. The traveling device may include a drive source such as an engine or a motor, and a wheel driven by the drive source, and may include the drive source and a crawler driven by the drive source.

Figure 2:
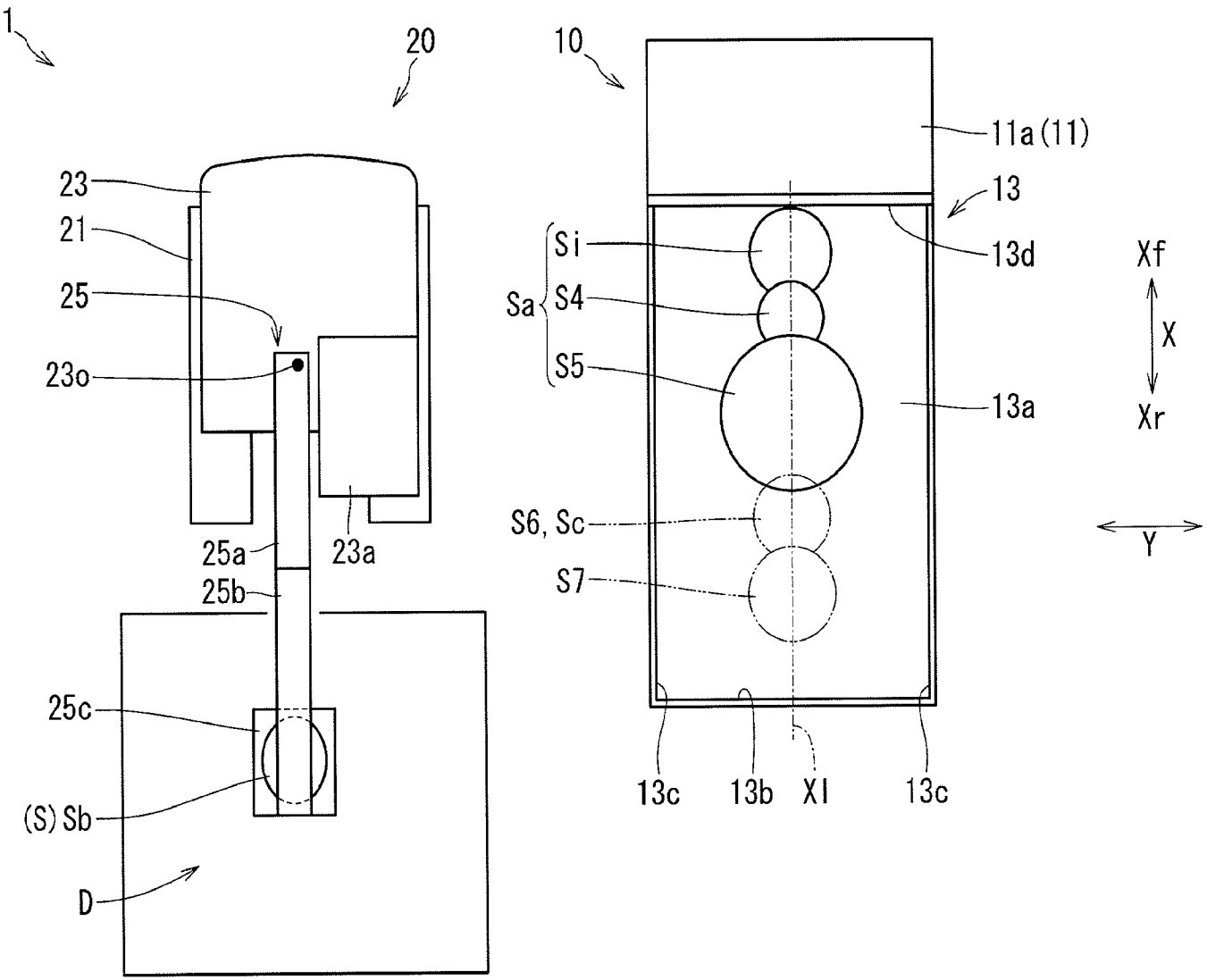
FIG. 2 is a plan view of the vehicle and the work machine, and illustrates another example of arrangement of the vehicle and the work machine.

The container 13 has a storage space capable of storing the load S to be loaded by the discharge operation repeatedly performed in the loading work. The container 13 has, for example, a box shape without a lid. The container 13 may be, for example, a cargo bed of the vehicle 10. However, the container in the present invention is not required to be a cargo bed of a vehicle, and may be, for example, a container for transportation that accommodates a load loaded by a discharge operation repeatedly performed in a loading work and is transported by a railway or the like. Hereinafter, a case where the container 13 is a cargo bed of the vehicle 10 will be described. The container 13 may be configured to be able to change its position with respect to the vehicle body 11 by moving relative to the vehicle body 11, or may be fixed to the vehicle body 11. The following is a description of a loading work performed in a state where the bottom surface 13*a* of the container 13 is disposed horizontally or approximately horizontally. As illustrated in FIGS. 1 and 2, the container 13 has a box shape in which a dimension in a front-rear direction (front-rear direction of the vehicle 10) is longer than a dimension in a left-right direction. Hereinafter, a longitudinal direction of the container 13 is referred to as a container longitudinal direction X.

In the present embodiment, the container longitudinal direction X coincides with the front-rear direction of the vehicle 10. The front-rear direction of the vehicle 10 is a longitudinal direction of the vehicle 10 as illustrated in FIGS. 1 and 2, and is a direction parallel to a horizontal direction when the vehicle 10 is disposed on a horizontal ground. Hereinafter, a direction parallel to the container longitudinal direction X (the front-rear direction of the vehicle 10) and directed from a rear end of the container 13 toward a front end of the container 13 is referred to as "forward Xf". In addition, a direction parallel to the container longitudinal direction X (the front-rear direction of the vehicle 10) and directed from the front end of the container 13 toward the rear end of the container 13 is referred to as "rearward Xr". Hereinafter, a horizontal direction orthogonal to the container longitudinal direction X is referred to as a container width direction Y.

Among the plurality of times of discharge operations performed in the loading work, the first discharge operation may be performed at a position close to one end of the container 13 in the container longitudinal direction X, and the position where the second and subsequent discharge operations are performed may approach the other end of the container 13 as the number of times of discharge operations increases. When the initial loading described later is performed, the initial loading including a plurality of times of discharge operations at the same position is performed at a position close to one end of the container 13 in the container longitudinal direction X, and the position where the subsequent discharge operations are performed may approach the other end of the container 13 as the number of times of the discharge operations increases. In the present embodiment, the first discharge operation in the loading work is performed at a position close to the front end of the container 13. Alternatively, the first discharge operation in the loading work may be performed at a position close to the rear end of the container 13.

The container 13 includes the bottom surface 13*a*, a rear gate board surface 13*b*, a pair of left and right side gate board surfaces 13*c*, and a guard surface 13*d*.

The bottom surface 13*a* is a bottom surface of the container 13. The bottom surface 13*a* is a planar or approximately planar surface. Similarly, the rear gate board surface 13*b*, the left side gate board surface 13*c*, the right side gate board surface 13*c*, and the guard surface 13*d* are planar or substantially planar surfaces. The rear gate board surface 13*b* is a surface located at a rear part of the container 13 in the container longitudinal direction X and facing forward Xf. The rear gate board surface 13*b* rises upward from the rear end of the bottom surface 13*a* in the container longitudinal direction X. The left side gate board surface 13*c* is a surface located at a left part of the container 13 in the container width direction Y and facing rightward. The right side gate board surface 13*c* is a surface located at a right part of the container 13 in the container width direction Y and facing leftward. The left side gate board surface 13*c* rises upward from a left end of the bottom surface 13*a*, and the right side gate board surface 13*c* rises upward from a right end of the bottom surface 13*a*. The guard surface 13*d* is a face located at a front part of the container 13 in the container longitudinal direction X and facing rearward Xr. The guard surface 13*d* rises upward from a front end of the bottom surface 13*a* in the container longitudinal direction X. As illustrated in FIG. 1, an upper end of the guard surface 13*d* may be located higher than upper ends of the pair of side gate board surfaces 13*c*, and may be located higher than an upper end of the rear gate board surface 13*b*.

The work machine 20 is a machine having the bucket 25*c*, and may be, for example, an excavator illustrated in FIG. 1. The work machine 20 is configured to be operable by automatic driving. That is, the work machine 20 is automated so as to operate on the basis of a command input from the controller 50. The work machine 20 may be operable on the basis of an operation by an operator in the cab 23*a* described later, or may be configured to operate on the basis of a remote operation by an operator at a remote location away from the work machine 20.

As illustrated in FIG. 1, the work machine 20 includes a lower traveling body 21, an upper slewing body 23, a work device 25 (attachment 25), a drive control unit 27 (see FIG. 3), and a plurality of actuators.

The lower traveling body 21 includes a traveling device that causes the work machine 20 to travel. The traveling device of the lower traveling body 21 may include a crawler driven by a drive source such as an engine or a motor, or may include a wheel driven by the drive source.

The upper slewing body 23 is slewably supported by the lower traveling body 21 so as to be able to slew. The center of slewing of the upper slewing body 23 with respect to the lower traveling body 21 is referred to as a slewing center 230 (see FIG. 2). The upper slewing body 23 includes the cab 23*a*. In the cab 23*a*, a seat on which an operator sits, an operation lever to which an operation for operating the work machine 20 is delivered by the operator, and the like are disposed.

The work device 25 is a device for performing work, and includes, for example, a boom 25*a*, an arm 25*b*, and the bucket 25*c*. The boom 25*a* is attached to the upper slewing body 2 so as to be raised and lowered (that is, so as to be vertically rotatable) with respect to the upper slewing body 23. The arm 25*b* is attached to the boom 25*a* so as to be rotatable with respect to the boom 25*a*. The bucket 25*c* is a portion constituting a distal end of the work device 25, and is attached to the arm 25*b* so as to be rotatable with respect to the arm 25*b*. The bucket 25*c* has a shape capable of accommodating the load S. The bucket 25*c* has a shape capable of scooping the load S.

The drive control unit 27 (see FIG. 3) controls an operation of the plurality of actuators for moving the work machine 20. The plurality of actuators may be hydraulic actuators operated by hydraulic pressure or electric actuators operated by electric power. When the plurality of actuators includes hydraulic actuators, the drive control unit 27 includes a hydraulic circuit. When the plurality of actuators includes electric actuators, the drive control unit 27 includes an electric circuit. Specifically, for example, the drive control unit 27 controls the operation of a hydraulic motor (slewing motor) (not shown) that slews the upper slewing body 23 with respect to the lower traveling body 21. The drive control unit 27 controls the operation of a hydraulic cylinder (boom cylinder) (not shown) that raises and lowers the boom 25*a* with respect to the upper slewing body 23. The drive control unit 27 controls the operation of a hydraulic cylinder (arm cylinder) (not shown) that rotates the arm 25*b* with respect to the boom 25*a*. The drive control unit 27 controls the operation of a hydraulic cylinder (bucket cylinder) (not shown) that rotates the bucket 25*c* with respect to the arm 25*b*.

In a case where each of the plurality of actuators is a hydraulic actuator, the drive control unit 27 may include a plurality of flow rate regulators that controls a flow rate and a direction of hydraulic oil supplied to the plurality of actuators. The plurality of flow rate regulators may include a boom flow rate regulator 27*a* for controlling a boom orientation that is an orientation of the boom 25*a* with respect to the upper slewing body 23, an arm flow rate regulator 27*b* for controlling an arm orientation that is an orientation of the arm 25*b* with respect to the boom 25*a*, a bucket flow rate regulator 27*c* for controlling a bucket orientation that is an orientation of the bucket 25*c* with respect to the arm 25*b*, and a slewing flow rate regulator 27*d* for controlling a slewing body orientation that is an orientation of the upper slewing body 23 with respect to the lower traveling body 21.

The boom flow rate regulator 27*a* operates in accordance with a command (boom command) input from the controller 50 to regulate the flow rate and direction of the hydraulic oil supplied to the boom cylinder. As a result, the boom orientation is regulated to an orientation according to the boom command. The boom flow rate regulator 27*a* may include, for example, a boom control valve interposed between a hydraulic pump (not shown) and the boom cylinder, and an electromagnetic proportional valve that adjusts pilot pressure supplied to a pilot port of the boom control valve. In this case, the boom command is input to the electromagnetic proportional valve.

The arm flow rate regulator 27*b* operates in accordance with a command (arm command) input from the controller 50 to regulate the flow rate and direction of the hydraulic oil supplied to the arm cylinder. As a result, the arm orientation is regulated to an orientation according to the arm command. The arm flow rate regulator 27*b* may include, for example, an arm control valve interposed between the hydraulic pump and the arm cylinder, and an electromagnetic proportional valve that adjusts pilot pressure supplied to a pilot port of the arm control valve. In this case, the arm command is input to the electromagnetic proportional valve.

The bucket flow rate regulator 27*c* operates in accordance with a command (bucket command) input from the controller 50 to regulate the flow rate and direction of the hydraulic oil supplied to the bucket cylinder. As a result, the bucket orientation is regulated to an orientation according to the bucket command. The bucket flow rate regulator 27*c* may include, for example, a bucket control valve interposed between the hydraulic pump and the bucket cylinder, and an electromagnetic proportional valve that adjusts pilot pressure supplied to a pilot port of the bucket control valve. In this case, the bucket command is input to the electromagnetic proportional valve.

The slewing flow rate regulator 27*d* operates in accordance with a command (slewing command) input from the controller 50 to regulate the flow rate and direction of the hydraulic oil supplied to the slewing motor. As a result, the slewing body orientation is regulated to an orientation according to the slewing command. The slewing flow rate regulator 27*d* may include, for example, a slewing control valve interposed between the hydraulic pump and the slewing motor, and an electromagnetic proportional valve that adjusts pilot pressure supplied to a pilot port of the slewing control valve. In this case, the slewing command is input to the electromagnetic proportional valve.

The orientation sensor 31 (see FIG. 3) detects information on an orientation of the work machine 20 and inputs a detection result to the controller 50. The orientation sensor 31 detects the position and direction of the work machine 20 with respect to a work site. The orientation sensor 31 may detect a slewing state of the upper slewing body 23 with respect to the lower traveling body 21, and may detect, for example, a slewing angle of the upper slewing body 23 with respect to the lower traveling body 21. The orientation sensor 31 may detect a state of rising and lowering of the boom 25*a* with respect to the upper slewing body 23, and may detect, for example, a rising and lowering angle of the boom 25*a* with respect to the upper slewing body 23. The orientation sensor 31 may detect a rotation state of the arm 25*b* with respect to the boom 25*a*, and may detect, for example, a rotation angle of the arm 25*b* with respect to the boom 25*a*. The orientation sensor 31 may detect a rotation state of the bucket 25*c* with respect to the arm 25*b*, and may detect, for example, a rotation angle of the bucket 25*c* with respect to the arm 25*b*.

Specifically, the orientation sensor 31 may include a sensor (for example, a rotary encoder) that detects an angle, may include a sensor that detects a degree of inclination with respect to a horizontal plane, or may include a sensor that detects a stroke of the hydraulic cylinder. The orientation sensor 31 may be configured to detect the orientation of the work machine 20 on the basis of at least one of a two-dimensional image or a distance image. In this case, at least one of the two-dimensional image or the distance image may be captured by the imaging device 35. That is, the orientation sensor 31 may be configured to detect the orientation of the work machine 20 by using image information acquired by the imaging device 35.

The orientation sensor 31 may be mounted on the work machine 20 or may be disposed outside the work machine 20 (for example, at a work site). Similarly, the in-bucket load information sensor 33, the imaging device 35, the input device 37, and the controller 50 illustrated in FIG. 3 may be mounted on the work machine 20 or may be disposed outside the work machine 20.

The in-bucket load information sensor 33 (see FIG. 3) detects in-bucket load information that is information on the amount of the load S in the bucket 25*c* illustrated in FIG. 1. The in-bucket load information may be, for example, information on the mass of the load S in the bucket 25*c* (the mass of the in-bucket load Sb). The in-bucket load information may be, for example, information on the volume of the load S in the bucket 25*c* (the volume of the in-bucket load Sb). The in-bucket load information may be both the information on the mass of the in-bucket load Sb and the information on the volume of the in-bucket load Sb. However, the in-bucket load information is only required to be the information on the amount of the load S in the bucket 25*c*, and is not limited to the information on the mass of the in-bucket load Sb and the information on the volume of the in-bucket load Sb.

When the in-bucket load information includes information on the mass of the in-bucket load Sb, the in-bucket load information sensor 33 may be, for example, a sensor that detects a load acting on the bucket 25*c*. The in-bucket load information sensor 33 may be a sensor that detects a load (specifically, hydraulic pressure) acting on the bucket cylinder. The in-bucket load information sensor 33 may be a sensor that detects a load acting on a link member (not shown) that connects the bucket cylinder, the bucket 25*c*, and the arm 25*b*. The in-bucket load information sensor 33 may be a sensor that detects a load (specifically, hydraulic pressure) acting on the boom cylinder. Each of the load acting on the bucket 25*c*, the load acting on the bucket cylinder, the load acting on the link member, and the load acting on the boom cylinder is a detection value correlated with the mass of the in-bucket load Sb. The in-bucket load information sensor 33 may input the detection value to the controller 50, and the controller 50 may calculate the mass of the in-bucket load Sb on the basis of the input detection value. The in-bucket load information sensor 33 may calculate the mass of the in-bucket load Sb on the basis of the detection value, and input a calculation result to the controller 50. In any case, the controller 50 can acquire the information on the mass of the in-bucket load Sb.

When the in-bucket load information includes the information on the volume of the in-bucket load Sb, the in-bucket load information sensor 33 may be a sensor that detects a two-dimensional image and a distance image of the in-bucket load Sb. At least one of the two-dimensional image or the distance image of the in-bucket load Sh may be included in data captured by the imaging device 35. The in-bucket load information sensor 33 may calculate the volume of the in-bucket load Sb on the basis of the two-dimensional image and the distance image of the load S, and input a calculation result to the controller 50. At least one of the in-bucket load information sensor 33 or the imaging device 35 may input data related to the two-dimensional image and the distance image of the in-bucket load Sb to the controller 50, and the controller 50 may calculate the volume of the in-bucket load Sb on the basis of the data. In any case, the controller 50 can acquire the information on the volume of the in-bucket load Sb.

Hereinafter, a case where the information on the amount of the in-bucket load Sb is the information on the mass of the in-bucket load Sb will be described.

The imaging device 35 captures an image of an imaging target that exists in an imageable range of the imaging device 35. For example, the imaging target of the imaging device 35 may be the vehicle 10, the container 13, or the load S in the container 13. The imaging target of the imaging device 35 may be the work machine 20, the work device 25, the bucket 25*c*, or the load S (in-bucket load Sb) in the bucket 25*c*. The imaging device 35 may be configured to detect two-dimensional information of the imaging target. The imaging device 35 may detect at least one of the position or the shape of the imaging target in a captured image. The imaging device 35 may include a camera (monocular camera) that detects two-dimensional information. The imaging device 35 may be configured to detect three-dimensional information of the imaging target. Specifically, for example, the imaging device 35 may detect at least one of three-dimensional coordinates or a three-dimensional shape of the imaging target, and may acquire image data (distance image data) including distance information (depth information) of the imaging target. The imaging device 35 may include a device that detects three-dimensional information by using laser light. The imaging device 35 may include, for example, light detection and ranging (LIDAR). The imaging device 35 may include, for example, a time of flight (TOF) sensor. The imaging device 35 may include a device (for example, a millimeter wave radar) that detects three-dimensional information by using radio waves. The imaging device 35 may include a stereo camera. The imaging device 35 may detect three-dimensional information of the imaging target including the distance image and the two-dimensional image.

The input device 37 (see FIG. 3) is a device for an operator to input information. When the input device 37 is provided in the work machine 20, the input device 37 may be included in, for example, a display disposed in the cab 23*a*, or may be included in a display disposed at a remote location. The input device 37 may be, for example, a portable information terminal such as a tablet or a smartphone.

The controller 50 (see FIG. 3) includes a computer that inputs and outputs signals, performs calculation processing, stores information, and the like. For example, the function of the controller 50 is implemented by executing a program stored in a memory of the controller 50. As illustrated in FIG. 3, the controller 50 receives various signals (a detection value, information input to the input device 37, and the like) from, for example, the orientation sensor 31, the in-bucket load information sensor 33, the imaging device 35, and the input device 37. For example, the controller 50 performs control for automatic driving of the work machine 20. As illustrated in FIG. 3, the controller 50 includes an in-bucket load information setting unit 51, a container position setting unit 53, a loaded object position setting unit 55, a discharge position calculator 60, and a command output unit 65.

The in-bucket load information setting unit 51 acquires information on the amount (for example, mass) of the in-bucket load Sb and stores the acquired information. As a result, information on the amount of the in-bucket load Sb is set in the controller 50. Specifically, as illustrated in FIG. 3, for example, the in-bucket load information setting unit 51 may acquire a detection value of the in-bucket load information sensor 33 and store the acquired detection value as information on the amount of the in-bucket load Sb. For example, the in-bucket load information setting unit 51 may acquire a detection value of the in-bucket load information sensor 33, calculate or determine the amount (for example, mass) of the in-bucket load Sb on the basis of the acquired detection value, and store the calculated or determined value as information on the amount of the in-bucket load Sb. As a result, the controller 50 sets information on the amount (for example, mass) of the load S in the bucket 25*c*. The in-bucket load information sensor 33 may calculate or determine the amount (for example, mass) of the in-bucket load Sb on the basis of the detection value, and input the calculated or determined value to the controller 50, and the controller 50 may store the input value as information on the amount of the in-bucket load Sb.

The container position setting unit 53 acquires information on the position of the container 13 and stores the acquired information. As a result, the information on the position of the container 13 is set in the controller 50. Since the position of the vehicle 10 is related to the position of the container 13, the container position setting unit 53 may acquire information on the position of the vehicle 10 and store the acquired information. As a result, the information on the position of the container 13 is set in the controller 50. The container position setting unit 53 may acquire information on a relative position of the container 13 with respect to the work machine 20 and store the acquired information. For example, when the container 13 is rectangular in plan view as illustrated in FIG. 2, the information on the position of the container 13 may include position information such as coordinates capable of specifying the positions of the four corners of the container 13 (or the positions of the four corners of the bottom surface 13*a* of the container 13). The information on the position of the container 13 may include position information such as coordinates capable of specifying the positions of three corners among the four corners of the container 13 (or the positions of three corners among the four corners of the bottom surface 13*a* of the container 13).

Specifically, for example, the container position setting unit 53 may calculate the position of the container 13 on the basis of information on the container 13 input from the imaging device 35, and store the calculated position as the information on the position of the container 13. As a result, the information on the position of the container 13 is set in the controller 50.

The container position setting unit 53 may calculate or determine the position of the container 13 on the basis of the information input to the input device 37 by the operator, and store the calculated or determined position as the information on the position of the container 13. As a result, the information on the position of the container 13 is set in the controller 50.

The container position setting unit 53 may acquire the information on the position of the container 13 by teaching and store the acquired information. As a result, the information on the position of the container 13 is set in the controller 50. The teaching may be performed as follows by an operator boarding the work machine 20 and operating the work machine 20 or by the operator remotely operating the work machine 20. For example, the operator operates the work machine 20 to arrange a specific part of the work device 25 at a specific position (for example, a corner position of the container 13) for setting the position of the container 13. The specific part of the work device 25 may be, for example, the distal end of the bucket 25*c*. At this time, the orientation sensor 31 detects an orientation of the work device 25 and inputs a detection result to the controller 50. As a result, the controller 50 acquires the detection result, that is, the information on the position of the container 13. The controller 50 calculates the position (coordinates) of the specific part of the work device 25 on the basis of the acquired detection result. Then, the container position setting unit 53 may calculate or determine the position of the container 13 on the basis of the position (coordinates) where the specific part of the working device 25 is disposed, and store the calculated or determined position as the information on the position of the container 13. As a result, the information on the position of the container 13 is set in the controller 50.

The loaded object position setting unit 55 acquires information on the position of a loaded object Sa in the container 13 and stores the acquired information. As a result, the information on the position of the loaded object Sa is set in the controller 50. The loaded object Sa is a bank formed by the load S loaded into the container 13 by performing the discharge operation at least once. Therefore, the loaded object Sa is a bank formed by a plurality of loads S loaded into the container 13 by the plurality of discharge operations when the discharge operation is performed a plurality of times. In the specific example illustrated in FIG. 5, since the loads S1 to S5 are loaded into the container 13 by five times of discharge operations, the loaded objects Sa in this case are formed by the loads S1 to S5. In the specific example illustrated in FIG. 5, the next discharge operation (that is, the sixth discharge operation) is performed on the basis of the target discharge position Xt.

For example, the loaded object position setting unit 55 may acquire three-dimensional information of the loaded object Sa and store the acquired three-dimensional information as information on the position of the loaded object Sa. For example, the loaded object position setting unit 55 may calculate the position of the loaded object Sa on the basis of the information input from the imaging device 35, and store the calculated position as the information on the position of the loaded object Sa. The loaded object position setting unit 55 may estimate or calculate the position of the loaded object Sa on the basis of, for example, the target discharge position (Xt-S5) used in the previous discharge operation (the fifth discharge operation in the specific example illustrated in FIG. 5) and the mass of the in-bucket load Sb discharged from the bucket 25*c* in the previous discharge operation, and store the estimated or calculated position as the information on the position of the loaded object Sa.

The discharge position calculator 60 (soil discharge position calculator) calculates the target discharge position Xt (target soil discharge position), which is a target position for the discharge operation, by using the information on the position of the container 13 set by the container position setting unit 53 and the information on the amount of the in-bucket load Sb set by the in-bucket load information setting unit 51. The calculation of the target discharge position Xt will be described in detail later.

The discharge position calculator 60 may include a height estimator 61. The height estimator 61 estimates the height of the load S (a next discharge load Sc) discharged from the bucket 25*c*. The height estimator 61 will be described later.

The command output unit 65 outputs a command for controlling the operation of the work machine 20 to the drive control unit 27. The command output unit 65 outputs a command for performing the discharge operation according to the target discharge position Xt to the drive control unit 27. As illustrated in FIG. 5, the command output unit 65 outputs a command to the drive control unit 27 such that the discharge operation for discharging the in-bucket load Sb from the bucket 25*c* into the container 13 is performed in accordance with the target discharge position Xt.

When the loading work is performed, the container 13 and the work machine 20 may be disposed as illustrated in FIG. 1 or may be disposed as illustrated in FIG. 2, for example. That is, the work machine 20 may be disposed such that the lower traveling body 21 and the upper slewing body 23 face the container 13 in the container longitudinal direction X as illustrated in FIG. 1, or may be disposed such that the lower traveling body 21 and the upper slewing body 23 face the container 13 in the container width direction Y as illustrated in FIG. 2. The work machine 20 may be disposed such that at least a part of the work machine 20 is positioned diagonally in front of or diagonally behind the container 13.

The loading work is performed as follows, for example. As illustrated in FIG. 2, there is a target area D in which a loading target exists near the work machine 20. When the loading target is earth and sand, for example, a mountain of earth and sand may be formed in the target area D. The work machine 20 captures the loading target, that is, the load S in the target area D with the bucket 25*c*. Specifically, for example, the command output unit 65 of the controller 50 outputs a command to the drive control unit 27 such that the bucket 25*c* excavates the earth and sand in the target area D. Then, the command output unit 65 outputs a command to the drive control unit 27 such that lifting and slewing operation is performed. The lifting and slewing operation is an operation in which the bucket 25*c* moves directly above the container 13 as the upper slewing body 23 slews with respect to the lower traveling body 21 while the bucket 25*c* is rising in a state where the bucket 25*c* is capturing the load S. Then, the command output unit 65 outputs a command to the drive control unit 27 such that the discharge operation is performed. The discharge operation is an operation for discharging the load S in the bucket 25*c* into the container 13. In other words, the command output unit 65 outputs a command to the drive control unit 27 such that the bucket 25*c* rotates with respect to the arm 25*b* directly above the container 13. As a result, the load S is discharged from the bucket 25*c*, and the discharged load S is accommodated in the container 13. After the discharge operation, the command output unit 65 outputs a command to the drive control unit 27 such that a return slewing operation is performed. The return slewing operation is an operation in which the bucket 25*c* moves to the target area D when the bucket 25*c* is lowered while the upper slewing body 23 is slewing with respect to the lower traveling body 21. In the loading work, the work machine 20 repeats a series of these operations by automatic operation by the controller 50.

As illustrated in FIG. 5, in the loading work, the work machine 20 performs the first discharge operation at a position close to one end of the container 13 in the container longitudinal direction X. In the present embodiment, the one end of the container 13 is the front end of the container 13, and the other end of the container 13 is the rear end of the container 13. However, the one end of the container 13 may be the rear end of the container 13, and in this case, the work machine 20 may perform the first discharge operation at a position close to the rear end of the container 13 in the loading work.

The controller 50 may control the operation of the work machine 20 such that the plurality of loads S are sequentially loaded into the container 13 along a straight line X1 (or near the straight line X1) extending in the container longitudinal direction X illustrated in FIG. 2. The straight line X1 may be a straight line extending in the container longitudinal direction X and overlapping the bottom surface 13*a* of the container 13 in plan view. Specifically, for example, the straight line X1 may be a straight line extending in the container longitudinal direction X and passing through the center of the bottom surface 13*a* of the container 13 in the container width direction Y in plan view. However, the straight line X1 may be a straight line extending in the container longitudinal direction X and passing through a position shifted in the container width direction Y from the center of the bottom surface 13*a* of the container 13 in the container width direction Y in plan view.

In the specific example illustrated in FIG. 5, the work machine 20 performs a plurality of times of discharge operations to discharge the load S1, the load S2, the load S3, the load S4, the load S5, the load S6, and the load S7 from the bucket 25*c* in that order to load the plurality of loads S into the container 13. The discharge position calculator 60 may calculate the plurality of target discharge positions Xt such that positions at which the plurality of loads S are loaded into the container 13 are gradually shifted from the front part toward the rear part of the container 13.

In the loading work in the present embodiment, the plurality of loads S are loaded on the straight line X1 (or substantially the straight line X1) illustrated in FIG. 2. In this case, each of the plurality of target discharge positions for the plurality of discharge operations may be set on the straight line X1 or may be set directly above the straight line X1.

In the loading work of loading the plurality of loads S into the container 13 on the straight line X1, the work machine 20 may perform an operation different (work different) from the operation of discharging the load S on the straight line X1 in a time zone between a certain discharge operation and the next discharge operation, specifically, for example, in a time zone between the discharge operation of discharging the load S4 into the container 13 and the discharge operation of discharging the load S5 to the container 13 in FIG. 5. For example, the work machine 20 may discharge the load S to a position away from the straight line X1 in the container width direction Y in the time zone. The position away from the straight line X1 in the container width direction Y may be a position inside the container 13 or a position outside the container 13. In the specific example shown in FIG. 5, since the loads S1, S2, S3, S4, S5, S6, and S7 are only required to be discharged into the container 13 in that order, these loads S does not need to be discharged continuously.

The target discharge position Xt is a target position for a discharge operation of discharging the in-bucket load Sb into the container 13. The target discharge position Xt may be, for example, a position set on the bottom surface 13*a* of the container 13 or a plane near the bottom surface 13*a*, and may be a target position at which the load S is loaded by the discharge operation. The target discharge position Xt may be, for example, a target position where a reference portion of the work device 25 is disposed when the discharge operation is performed. The reference portion is any portion of the work device 25 determined in advance. The reference portion will be described in detail later.

The discharge position calculator 60 of the controller 50 sequentially calculates the plurality of target discharge positions Xt corresponding to a plurality of times of discharge operations in the loading work. The discharge position calculator 60 calculates the next target discharge position Xt such that the target discharge position Xt for the next discharge operation is shifted rearward Xr along the straight line X1 from the target discharge position Xt for a certain discharge operation.

In the present embodiment illustrated in FIG. 5, the discharge position calculator 60 sets the plurality of target discharge positions Xt within a predetermined range between both ends of the container 13 in the container longitudinal direction X. Specifically, the predetermined range is a range from a loading range front end X0 to a loading range rear end Xe. The discharge position calculator 60 sets each of the plurality of target discharge positions Xt within the range from the loading range front end X0 to the loading range rear end Xe.

The loading range front end X0 is set near the front end of the container 13 in the container longitudinal direction X. The loading range front end X0 is set to such a position that the bucket 25*c* does no contact the container 13 when the bucket 25*c* discharges the load S at a position corresponding to the loading range front end X0 (for example, a position directly above the loading range front end X0). Specifically, the loading range front end X0 is set rearward Xr by a predetermined distance L0 from the front end of the container 13 in the container longitudinal direction X.

The discharge position calculator 60 may set the predetermined distance L0 on the basis of, for example, information imaged by the imaging device 35 (see FIG. 3), or may set the predetermined distance L0 on the basis of a value input to the input device 37 (see FIG. 3). The predetermined distance L0 may be a fixed value set in advance in the controller 50. The discharge position calculator 60 may set the predetermined distance L0 by, for example, teaching. The teaching may be similar to, for example, the above-described method used when the container position setting unit 53 sets the information on the position of the container 13. The predetermined distance L0 may be set on the basis of the dimensions of the container 13, may be set on the basis of a dimension of the bucket 25*c*, or may be set on the basis of a region (trajectory) through which the bucket 25*c* passes when the bucket 25*c* rotates with respect to the arm 25*b*.

The loading range rear end Xe is set near the rear end of the container 13 in the container longitudinal direction X. Similarly to the loading range front end X0, the loading range rear end Xe is set to such a position that the bucket 25*c* does not contact the container 13 when the bucket 25*c* discharges the load S at a position corresponding to the loading range rear end Xe (for example, a position directly above the loading range rear end Xe). Specifically, the loading range rear end Xe is set forward Xf by a predetermined distance from the rear end in the container longitudinal direction X. A setting method of the predetermined distance similar to a setting method of the predetermined distance L0 can be used, and the predetermined distance may be the same value as the predetermined distance L0 or a value different from the predetermined distance L0.

The target discharge position Xt may be specified by coordinates in a two-dimensional coordinate system or may be specified by coordinates in a three-dimensional coordinate system. Specifically, the target discharge position Xt may be specified by coordinates in a two-dimensional coordinate system in a reference plane. The reference plane may be, for example, a horizontal plane, a reference plane such as the bottom surface 13*a* of the container 13, a ground surface, or a plane parallel to the bottom surface 13*a* or the ground surface.

The target discharge position Xt may be a target position at which the reference portion of the work device 25 is disposed in an orientation in which the bucket 25*c* accommodates the in-bucket load Sb (for example, an orientation of the bucket 25*c* in FIG. 5). The reference portion may be, for example, a portion of the bucket 25*c* set in advance. Specifically, the reference portion may be the distal end of the bucket 25*c*, a center of the bucket 25*c*, or a rear end of the bucket 25*c*. More specifically, the distal end of the bucket 25*c* may be at a center in a width direction of the bucket 25*c* at the distal end of the bucket 25*c*. The center of the bucket 25*c* may be the center in the width direction of the bucket 25*c* and a center in a direction orthogonal to the width direction of the bucket 25*c*. The rear end of the bucket 25*c* may be at a center in a width direction of the bucket 25*c* at the rear end of the bucket 25*c*. The reference portion may be a portion of the arm 25*b* set in advance, and in this case, the reference portion may be a distal end of the arm 25*b*.

The target discharge position Xt may be a position corresponding to a top of a mountain of earth and sand predicted to be formed by the load S6 (next discharge load Sc) discharged from the bucket 25*c* in the next discharge operation (sixth discharge operation in the specific example illustrated in FIG. 5).

When the lower traveling body 21 and the upper slewing body 23 are disposed so as to face the container 13 in the container width direction Y as illustrated in FIG. 2, the target discharge position Xt may be a target position at which the center (or substantially the center) of the bucket 25*c* in the width direction of the bucket 25*c* is disposed in an orientation in which the bucket 25*c* accommodates the in-bucket load Sb. The width direction of the bucket 25*c* is the left-right direction (left-right direction in FIG. 2) as viewed from the cab 23*a*. In other words, the width direction of the bucket 25*c* is, for example, a direction of a tangent of an arc indicating a slewing direction of the upper slewing body 23 about the slewing center 230 illustrated in FIG. 2.

As illustrated in FIG. 1, when the lower traveling body 21 and the upper slewing body 23 are disposed so as to face the container 13 in the container longitudinal direction X, the target discharge position Xt may be a target position at which the center (or substantially the center) of the bucket 25*c* in the container longitudinal direction X is disposed in an orientation in which the bucket 25*c* accommodates the in-bucket load Sb. In the case of the arrangement illustrated in FIG. 1, the target discharge position Xt may be a target position at which the distal end of the arm 25*b* (a proximal end of the bucket 25*c*) is disposed in an orientation in which the bucket 25*c* accommodates the in-bucket load Sb.

The discharge position calculator 60 of the controller 50 preferably calculates the target discharge position Xt for the discharge operation at the same position such that the discharge operation is performed at the same position (loading start position) a plurality of times from a start of the loading work until a preset initial loading end condition is satisfied. Hereinafter, performing a plurality of times of discharge operations at the same position from the start of the loading work until the initial loading end condition is satisfied is referred to as "initial loading". The controller 50 calculates the target discharge position Xt such that the initial loading is performed and outputs a command to the drive control unit 27 such that the initial loading is performed during a period from the start of the loading work until the initial loading end condition is satisfied.

The loading start position is set at or near one end of the container 13 in the container longitudinal direction X. The loading start position may be set, for example, at the loading range front end X0 described above, or may be set at a position shifted forward Xf or backward Xr from the loading range front end X0. In the specific example illustrated in FIG. 5, the loading start position is set at the loading range front end X0.

The number of times of the discharge operations in the initial loading, that is, the number of times of the discharge operations at the loading start position is not limited and is appropriately set in consideration of the specifications of the container 13 such as the shape and size of the container 13, the specifications of the work device 25 such as the size of the bucket 25*c*, the type of the load S, and the like. In the specific example illustrated in FIG. 5, the number of times of the discharge operations at the loading start position is set to three. Therefore, in the specific example illustrated in FIG. 5, by executing the initial loading, the load S1, the load S2, and the load S3 are loaded into the container 13 in that order at the loading start position (loading range front end X0).

When the initial loading ends, the controller 50 sequentially calculates the plurality of target discharge positions such that the plurality of target discharge positions for the subsequent plurality of times of discharge operations gradually move rearward Xr away from the loading start position (loading range front end X0). As a result, the loading of the load S after the initial loading into the container 13, that is, the discharge operation after the initial loading is performed at a position rearward Xr of the loading start position (loading range front end X0) where the initial loading has been performed.

The loaded object at a time when the initial loading is finished is a deposit formed by three loads S1, S2, and S3 loaded into the container 13 by performing three times of discharge operations at the same position (loading start position). In the specific example illustrated in FIG. 5, the loaded object Sa at a time when the fifth discharge operation is completed is depicted by a solid line in FIG. 5, and is formed by five loads S1, S2, S3, S4, and S5 loaded into the container 13 by performing five times of discharge operations.

After the end of the initial loading, the controller 50 calculates the target discharge position Xt for the next discharge operation such that a distance (for example, a distance in the container longitudinal direction X) between one end of the container 13 in the container longitudinal direction X (the front end of the container 13 in the present embodiment) and the target discharge position Xt for the next discharge operation increases as the amount of the loaded object increases. The above will be described below with a specific example. A loaded object at a time when the fourth discharge operation is completed, that is, a loaded object at a time when the fifth discharge operation is started is formed by the four loads S1 to S4. A loaded object at a time when the fifth discharge operation is completed, that is, a loaded object at a time when the sixth discharge operation is started is formed by the five loads S1 to S5. The amount of the loaded object at the time of starting the sixth discharge operation is larger than the amount of the loaded object at the time of starting the fifth discharge operation. Therefore, the distance between the front end of the container 13 and the target discharge position Xt for the sixth discharge operation is larger than the distance between the front end of the container 13 and the target discharge position Xt ("Xt-S5" in FIG. 5) for the fifth discharge operation.

Figure 4:
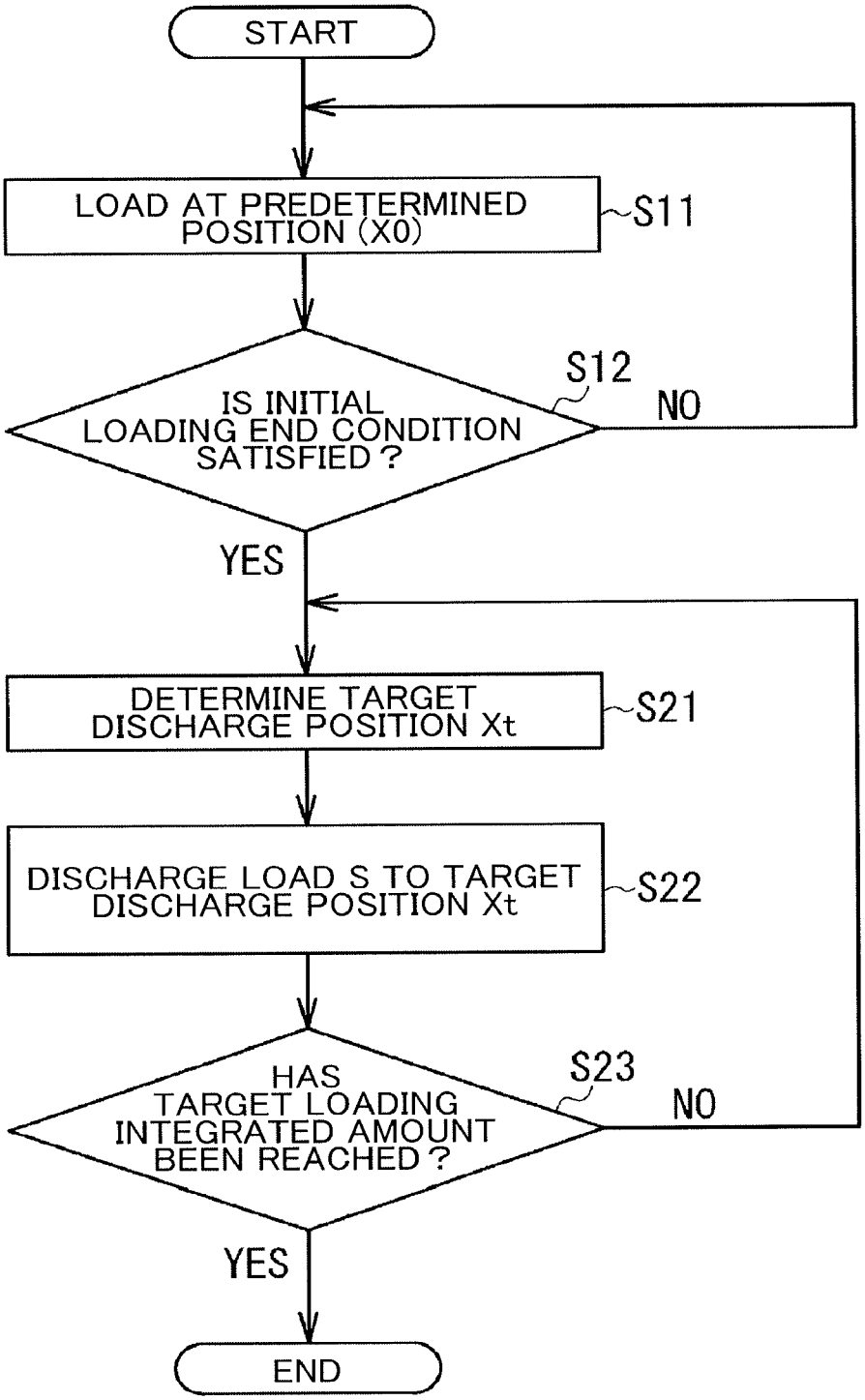
FIG. 4 is a flowchart illustrating calculation processing performed by a controller of the load discharge system.

FIG. 4 is a flowchart illustrating a calculation processing operation by the controller 50 of the load discharge system 1. The controller 50 controls the operation of the work machine 20 such that the work machine 20 performs the loading work including the initial loading. Steps S11 and S12 in FIG. 4 are calculation processing by the controller 50 for the initial loading. In the initial loading, the discharge position calculator 60 of the controller 50 calculates the target discharge position Xt such that the load S is discharged from the bucket 25*c* a plurality of times at the same position (loading range front end X0) from the start of the loading work until the initial loading end condition is satisfied (steps S11 and S12 in FIG. 4). At the start of the loading work, no or almost no load S is loaded into the container 13. For example, the controller 50 may specify a start time of the loading work on the basis of the image data of the container 13 input from the imaging device 35 to the controller 50. The controller 50 may specify the start time of the loading work on the basis of, for example, an input for instructing the input device 37 to start the loading work performed by the operator.

The initial loading end condition is set in advance and stored in the controller 50 (for example, the discharge position calculator 60). The initial loading end condition is set before the initial loading is performed. A specific example of the initial loading end condition will be described later. The discharge position calculator 60 calculates the target discharge position Xt such that a plurality of discharge operations are performed at the loading range front end X0 from the start of the loading work until the initial loading condition is satisfied. The command output unit 65 outputs a command to the drive control unit 27 such that the plurality of loads S, namely, the loads S1, S2, and S3 are sequentially discharged from the bucket 25*c* directly above the target discharge position Xt for the initial loading, that is, the loading range front end X0. By performing such initial loading, the load S1, the load S2, and the load S3 are loaded into the container 13 so as to overlap at the same position (or substantially the same position) as illustrated in FIG. 5. An initial load (deposit) constituted by a plurality of loads S1, S1, and S3 to be loaded into the container 13 in the initial loading is referred to as an "initial load Si" (see FIG. 5).

The advantages of the initial loading are as follows. At the start of the loading work, no or almost no load S is loaded into the container 13. Therefore, the load S that has been discharged from the bucket 25*c* and has fallen on the bottom surface 13*a* of the container 13 at the start of the loading work tends to easily spread outward in the horizontal direction from the position of the fall. This is because there is no other load S (that is, no loaded object) near the load S having fallen on the bottom surface 13*a* at the start of the loading work, and thus there is no loaded object nearby against which the load S having fallen on the bottom surface 13*a* can lean at the start of the loading work. Therefore, it is assumed that the height of the load S having been discharged from the bucket 25*c* and fallen on the bottom surface 13*a* at the start of the loading work is lower than the height from the bottom surface 13*a* when there is a sufficient loaded object nearby against which the load S having fallen on the bottom surface 13*a* can lean (specifically, for example, when the discharge operation of the loads S4 and S5 is performed after the initial loading). Therefore, at the start of the loading work, the load S is discharged a plurality of times at the same position (or substantially the same position) until the initial loading end condition is satisfied. As a result, the difference between the height from the bottom surface 13*a* of the load S (initial load Si) discharged a plurality of times at the start of the loading work and the height from the bottom surface 13*a* of the load S discharged after the initial loading end condition is satisfied is likely to be small as illustrated in FIG. 5.

The initial loading end condition is preferably set such that the height of the initial load Si and the height of the load S (loads S4, S5, and the like) discharged from the bucket 25*c* into the container 13 by the discharge operation performed after the initial loading end condition is satisfied are as equal as possible. Specific examples of the initial loading end condition include the following [Example 1a] to [Example 1d].

[Example 1a] The initial loading end condition may include a fact that the number of times of the discharge operation at the same position (loading start position) reaches a preset value (predetermined number of times). The predetermined number of times may be a fixed value set in advance in the discharge position calculator 60, or may be a value input by the input device 37 (see FIG. 3).

[Example 1b] The initial loading end condition may include a fact that a total amount of the load (that is, the amount of the initial load Si) loaded into the container 13 by the discharge operation at the same position (loading start position) exceeds a preset value (predetermined amount). In the present embodiment, the amount of the initial load Si is a sum of the amount of the load S1, the amount of the load S2, and the amount of the load S3. The amount of the initial load Si may be, for example, the mass of the initial load Si. In this case, the mass of the initial load Si is an integrated value of the mass of the load S1, the mass of the load S2, and the mass of the load S3 detected by the in-bucket load information sensor 33 (see FIG. 3). The predetermined amount may be a fixed value set in advance in the discharge position calculator 60, or may be a value input by the input device 37 (see FIG. 3).

[Example 1c] The initial loading end condition may include a fact that the height of the deposit formed by the load S loaded into the container 13 by the discharge operation at the same position (loading start position) exceeds a preset value (predetermined height). In the present embodiment, the height of the deposit is the height of the initial load Si from the bottom surface 13*a* of the container 13. The predetermined height may be a fixed value set in advance in the discharge position calculator 60, may be a value input by the input device 37 (see FIG. 3), or may be a value set by teaching. For example, the discharge position calculator 60 may calculate (detect) the height of the initial load Si on the basis of at least one of a two-dimensional image or a distance image of the initial load Si captured by the imaging device 35 (see FIG. 3). The discharge position calculator 60 may calculate (estimate) the height of the initial load Si on the basis of the mass of the initial load Si (integrated value of masses of the loads S1, S2, and S3) discharged from the bucket 25*c*.

[Example 1d] The initial loading end condition may be a various combination of conditions of Examples 1a to 1c described above. For example, the initial loading end condition may include only any one condition of Examples 1a to 1c. The initial loading end condition may include two or more conditions of Examples 1a to 1c, and in this case, the controller 50 may determine that the initial loading end condition is satisfied when any one of the two or more conditions is satisfied, and may determine that the initial loading end condition is satisfied when the two or more conditions are satisfied.

Note that the initial loading described above does not need to be performed in the loading work. In this case, when the loading work is started, the discharge position calculator 60 of the controller 50 calculates the target discharge position Xt such that, for example, the first discharge operation is performed at the loading range front end X0, and sequentially calculates the plurality of target discharge positions Xt such that the plurality of target discharge positions Xt for the second and subsequent discharge operations gradually move rearward Xr away from the loading range front end X0.

When the initial loading end condition is satisfied (YES in step S12 in FIG. 4), the controller 50 performs the processing in and after step S21 in FIG. 4. After the initial loading is finished, the discharge position calculator 60 of the controller 50 calculates (determines) the target discharge position Xt such that the target discharge position Xt is set at a position rearward Xr of the loading start position (for example, the loading range front end X0) (step S21 in FIG. 4).

The discharge position calculator 60 calculates the target discharge position Xt such that the target discharge position Xt approaches the other end of the container 13 (the rear end of the container 13 in the present embodiment) as the loading work of the load S into the container 13 progresses. In other words, in the loading work after the end of the initial loading, the discharge position calculator 60 calculates each of the plurality of target discharge positions Xt such that the target discharge position Xt gradually shifts rearward Xr as the number of times of the discharge operations increases.

The discharge position calculator 60 calculates the target discharge position Xt such that a distance Lt illustrated in FIG. 5 increases as the amount of the loaded object Sa (the mass of the loaded object Sa in the present embodiment) formed by the load S already loaded into the container 13 increases. The distance Lt is a distance in the container longitudinal direction X between a reference position set in advance at or near one end of the container 13 in the container longitudinal direction X and the target discharge position Xt for the next discharge operation. In the specific example shown in FIG. 5, the reference position is the loading range front end X0, but the reference position may be, for example, one end of the container 13 in the container longitudinal direction X.

In the specific example illustrated in FIG. 5, the next discharge operation is the sixth discharge operation, and the loaded object Sa at the time when the sixth discharge operation is started is formed by the loads S1 to S5. In this case, the discharge position calculator 60 calculates the target discharge position Xt for the sixth discharge operation, that is, the target discharge position Xt for discharging the load S6 from the bucket 25*c* into the container 13. The target discharge position Xt for the sixth discharge operation is a position indicated by an upward arrow Xt depicted at a position corresponding to a one-dot chain line extending vertically in FIG. 5. An upward arrow denoted by "Xt-S4" in FIG. 5 indicates the target discharge position for the fourth discharge operation, that is, the target discharge position used when the load S4 is discharged from the bucket 25*c* into the container 13. An upward arrow denoted by "Xt-S5" in FIG. 5 indicates the target discharge position for the fifth discharge operation, that is, the target discharge position used when the load S5 is discharged from the bucket 25*c* into the container 13. Similarly, an upward arrow denoted by "Xt-S7" in FIG. 5 indicates the target discharge position for the seventh discharge operation to be performed after the load S6 is discharged, that is, the target discharge position to be used when the load S7 is discharged from the bucket 25*c* into the container 13.

The discharge position calculator 60 of the controller 50 may calculate the target discharge position Xt on the basis of the amount (mass) of the in-bucket load Sb which is the load S in the bucket 25*c*.

Specifically, the discharge position calculator 60 calculates the target discharge position Xt for the next discharge operation such that a shift amount Ls that is a distance between the loaded object Sa in the container 13 and the target discharge position Xt for the next discharge operation increases as the mass of the in-bucket load Sb increases. The shift amount Ls is a distance in the container longitudinal direction X from an end of the loaded object Sa in the rearward Xr to the target discharge position Xt for the next discharge operation. A horizontal arrow denoted by "Ls-S4" in FIG. 5 indicates a distance (shift amount) between the loaded object at a time when the third discharge operation is completed, that is, the loaded object (initial load Si) formed by the loads S1, S2, and S3 and the target discharge position Xt-S4 for the fourth discharge operation. A horizontal arrow denoted by "Ls-S5" in FIG. 5 indicates a distance (shift amount) between the loaded object at a time when the fourth discharge operation is completed, that is, the loaded object formed by the loads S1, S2, S3, and S4 and the target discharge position Xt-S5 for the fifth discharge operation.

Here, what is formed in the container 13 when the load S6 discharged from the bucket 25*c* falls on the bottom surface 13*a* in the next discharge operation (the sixth discharge operation in the specific example of FIG. 5) is referred to as the next discharge load Sc. The discharge position calculator 60 may calculate the next target discharge position Xt such that the end of the next discharge load Sc in the forward Xf is in contact with (overlaps) the end of the loaded object Sa in the rearward Xr. That is, when the container 13 is viewed from above as illustrated in FIG. 2, the discharge position calculator 60 may calculate the target discharge position Xt for the next (sixth) discharge operation such that the end of the next discharge load Sc in the forward Xf overlaps the end of the loaded object Sa in the rearward Xr.

The discharge position calculator 60 is not limited to the above specific example, and can calculate the target discharge position Xt by using various methods. Specifically, for example, the discharge position calculator 60 may calculate the target discharge position Xt by using a target loading integrated amount described later (for example, the following Calculation Example 1). The discharge position calculator 60 may calculate the target discharge position Xt without using the target loading integrated amount (for example, the following Calculation Example 2).

Calculation Example 1

In Calculation Example 1, the discharge position calculator 60 calculates the target discharge position Xt by using the target loading integrated amount. The target loading integrated amount may be a target value of a total amount (total mass) of the load S to be loaded into the container 13 by repeatedly performing the discharge operation. The target loading integrated amount may be a target value of the amount (mass) of the load S in the entire container 13. For example, the discharge position calculator 60 may set the target loading integrated amount on the basis of an input value input to the input device 37 (see FIG. 3). The discharge position calculator 60 may set (calculate) the target loading integrated amount on the basis of information of the container 13 imaged by the imaging device 35 illustrated in FIG. 1 (for example, information on specifications such as the dimension and the shape of the container 13). The target loading integrated amount may include or need not include the mass of the initial load Si.

The discharge position calculator 60 of the controller 50 may calculate a sum of the mass of a part or all of the loaded object Sa in the container 13 and the mass of the in-bucket load Sb which is the load S in the bucket 25*c*, calculate a ratio Rm of the sum and the target loading integrated amount, and calculate the target discharge position Xt for the next discharge operation by using the ratio Rm.

Specifically, the discharge position calculator 60 may calculate a sum (Sa+Sb) of the mass of all of the loaded object Sa in the container 13 and the mass of the in-bucket load Sb, calculate the ratio Rm of the sum and the target loading integrated amount, and calculate the target discharge position Xt for the next discharge operation by using the ratio Rm.

The discharge position calculator 60 may calculate a sum of the mass of a part of the loaded object Sa in the container 13 and the mass of the in-bucket load Sb, calculate the ratio Rm of the sum and the target loading integrated amount, and calculate the target discharge position Xt for the next discharge operation by using the ratio Rm. The part of the loaded object Sa may be, for example, a remainder obtained by removing the initial load Si from the entire loaded object Sa. In the specific example illustrated in FIG. 5, the loaded object Sa is formed by the loads S1 to S5, and the initial load Si is constituted by the loads S1 to S3. As a result, the part of the loaded object Sa is constituted by the loads S4 and S5.

The controller 50 can acquire or calculate each of the mass of a part of the loaded object Sa, the mass of all of the loaded object Sa, and the mass of the in-bucket load Sb on the basis of information input from the in-bucket load information sensor 33.

The ratio Rm is a value (sum/target loading integrated amount) obtained by dividing the sum by the target loading integrated amount.

Here, as illustrated in FIG. 5, a length from the loading range front end X0 to the loading range rear end Xe in the container longitudinal direction X is defined as a distance Le. In addition, a length in the container longitudinal direction X from the loading range front end X0 to the target discharge position Xt for the next (for example, sixth) discharge operation is defined as the distance Lt. A ratio between the distance Le and the distance Lt (for example, Lt/Le) is defined as a distance ratio RI. At this time, the discharge position calculator 60 calculates the distance Lt such that the distance ratio RI becomes equal to the ratio Rm. Then, the discharge position calculator 60 calculates (determines) the target discharge position Xt by using the distance Lt.

The discharge position calculator 60 may calculate the target discharge position Xt by using the ratio Rm, for example, as follows. Variables used in this calculation are defined and calculated as follows, for example.

"Total_pre" is a mass (initial loading integrated amount) of the initial load Si, and is the integrated value of the masses of the loads S1, S2, and S3 in the specific example illustrated in FIG. 5.

"Target" is a target value of the mass of the load S of the entire container 13 (the target loading integrated amount described above).

"Target2" is a value (Target-Total_pre) obtained by subtracting the initial loading integrated amount (Total_pre) from the target loading integrated amount (Target).

"Total" is a sum of the mass of a part of the loaded object Sa and the mass of the in-bucket load Sb. That is, "Total" is a sum of a value obtained by subtracting the mass of the initial load Si from the mass of the loaded object Sa and the mass of the in-bucket load Sb. In the specific example illustrated in FIG. 5, "Total" is a sum of the mass of the load S4, the mass of the load S5, and the mass of the in-bucket load Sb.

As described above, the "distance Le" is a distance in the container longitudinal direction X from the loading range front end X0 to the loading range rear end Xe, and the "distance Lt" is a distance in the container longitudinal direction X from the loading range front end X0 to the next target discharge position Xt.

The discharge position calculator 60 calculates the distance Lt by using the following equation.

$$Lt = Le \times \text{Total} / Target2$$

"Total/Target2" in this equation is a value obtained by dividing "Total" by "Target2", and is the above ratio Rm. The discharge position calculator 60 can calculate the distance Lt by using the above equation, and can obtain the position of the next target discharge position Xt in the container longitudinal direction X.

The discharge position calculator 60 may calculate the sum (Sa+Sb) of the mass of all of the loaded object Sa in the container 13 and the mass of the in-bucket load Sb, calculate the ratio Rm of the sum and the target loading integrated amount, and calculate the target discharge position Xt for the next discharge operation by using the ratio Rm. The distance Lt may be calculated on the basis of a value obtained by performing at least one of addition, subtraction, or multiplication of a predetermined value on the values such as Total, Target2, and the ratio Rm. [Calculation Example 2]

In Calculation Example 2, the discharge position calculator 60 calculates the target discharge position Xt without using the target loading integrated amount. For example, the discharge position calculator 60 may calculate the target discharge position Xt on the basis of the position of the loaded object Sa and the mass of the in-bucket load Sb.

Specifically, in Calculation Example 2, the discharge position calculator 60 calculates the shift amount Ls in accordance with the mass of the in-bucket load Sb. The discharge position calculator 60 increases the shift amount Ls as the amount (mass) of the in-bucket load Sb increases. The reason for the above is as follows. In the specific example illustrated in FIG. 5, when the in-bucket load Sb is discharged from the bucket 25*c* by the next discharge operation, the next discharge load Sc is formed on the bottom surface 13*a* of the container 13. The degree to which the next discharge load Sc overlaps the end of the loaded object Sa varies depending on the mass of the in-bucket load Sb and varies depending on the shift amount Ls. Specifically, the degree of the overlap increases as the mass of the in-bucket load Sb increases, and increases as the shift amount Ls decreases. The discharge position calculator 60 calculates the shift amount Ls such that the height of the loaded object Sa and the height of the next discharge load Sc are as equal as possible (as same as possible).

The shift amount Ls is a distance in the container longitudinal direction X between the loaded object Sa in the container 13 and the target discharge position Xt for the next discharge operation. Specifically, as illustrated in FIG. 5, the shift amount Ls is a distance in the container longitudinal direction X from an end Sal of the loaded object Sa in the rearward Xr to the target discharge position Xt for the next discharge operation. The end Sal of the loaded object Sa does not need to be strictly an end of the loaded object Sa in the rearward Xr. For example, the end Sal of the loaded object Sa may be an end of the loaded object Sa at a position higher than the bottom surface 13*a* of the container 13 by a predetermined height (for example, a position several centimeters above the bottom surface 13*a*, a position several tens of centimeters above the bottom surface 13*a*, and the like).

The controller 50 may acquire information on the height of the loaded object Sa in the container 13, and calculate the target discharge position Xt for the next discharge operation by using the information on the height of the loaded object Sa and the information on the amount (for example, mass) of the in-bucket load Sb. The controller 50 can calculate or determine the height of the loaded object Sa in the container 13 by using, for example, image data input from the imaging device 35. The controller 50 may store in advance a relational expression that defines a relationship between the mass of the in-bucket load Sb, the shift amount Ls, and the height of the next discharge load Sc. In this case, the discharge position calculator 60 can calculate the shift amount Is that allows the height of the next discharge load Sc to become the height of the loaded object Sa by using the mass of the in-bucket load Sb, the height of the loaded object Sa, and the relational expression. Then, the discharge position calculator 60 sets a position shifted backward Xr by the shift amount Ls from the position of the end Sal of the loaded object Sa as the target discharge position Xt for the next discharge operation.

The height estimator 61 (see FIG. 3) may estimate the height of the next discharge load Sc when the in-bucket load Sb is discharged to a position shifted from the loaded object Sa by the predetermined shift amount Ls. Then, the discharge position calculator 60 may calculate the target discharge position Xt by using the estimated height of the next discharge load Sc and the shift amount Ls. Specifically, for example, the discharge position calculator 60 calculates the shift amount Ls that allows the height of the next discharge load Sc to be equal to the height of the loaded object Sa (for example, the height detected by the imaging device 35). Then, the discharge position calculator 60 sets a position shifted backward Xr by the shift amount Ls from the position of the end Sal of the loaded object Sa as the target discharge position Xt.

The height estimator 61 (see FIG. 3) may estimate the height of the next discharge load Sc by using a relational expression (map) that defines the relationship between the mass of the in-bucket load Sb, the shift amount Ls, and the height of the next discharge load Sc. This map is set in advance (before the estimation of the height) in the height estimator 61. The controller 50 may acquire the relational expression defined in the map by using, for example, a machine learning method.

The discharge position calculator 60 may calculate the shift amount Is without estimating the height of the next discharge load Sc by the height estimator 61. For example, the discharge position calculator 60 may calculate the shift amount Ls by using a relational expression (map) that defines the relationship between the mass of the in-bucket load Sb and the shift amount Ls.

Even if the mass of the in-bucket load Sb and the shift amount Ls are the same, the height of the next discharge load Sc may change depending on the shape of the loaded object Sa. Therefore, the discharge position calculator 60 may calculate the target discharge position Xt on the basis of the shape of the loaded object Sa. Specifically, for example, the height estimator 61 may estimate the height of the next discharge load Sc by using a relational expression (map) that defines the relationship between the mass of the in-bucket load Sb, the shape of the loaded object Sa, the shift amount Ls, and the height of the next discharge load Sc. For example, the height of the next discharge load Sc estimated by the map may be corrected on the basis of the shape of the loaded object Sa. The shift amount Ls calculated by the discharge position calculator 60 may be corrected on the basis of the shape of the loaded object Sa.

The controller 50 controls the operation of the work machine 20 (the position of the bucket 25*c*) such that the load S is discharged to the target discharge position Xt calculated by the discharge position calculator 60 (step S22 illustrated in FIG. 4). Specifically, the command output unit 65 of the controller 50 outputs, to the drive control unit 27, a command for moving the work machine 20 such that the load S is discharged to the target discharge position Xt. Then, the drive control unit 27 controls the operation of at least one actuator corresponding to the command among the plurality of actuators. As a result, the load S is discharged from the bucket 25*c* to the target discharge position Xt. For example, the drive control unit 27 rotates the bucket 25*c* with respect to the ground surface (with respect to the arm 25*b*) in a state where the bucket 25*c* is disposed above (directly above or substantially directly above) the target discharge position Xt. As a result, the load S is discharged from the bucket 25*c*, and the load S falls to the target discharge position Xt.

When the target loading integrated amount is set in the controller 50, the controller 50 determines whether the amount of the loaded object Sa has reached the target loading integrated amount or whether the sum of the amount of the loaded object Sa and the amount of the in-bucket load Sb has reached the target loading integrated amount (step S23 in FIG. 4). When the amount or the sum of the loaded objects Sa has not reached the target loading integrated amount (NO in step S23), the discharge position calculator 60 returns to step S21 and calculates the next target discharge position Xt. When the amount of the loaded object Sa or the sum has reached the target loading integrated amount (YES in step S23), the controller 50 ends the loading work of the load S into the container 13.

When the discharge position calculator 60 calculates the target discharge position Xt on the basis of the shift amount Ls (see Calculation Example 2), the controller 50 may determine whether the target discharge position Xt has reached the loading range rear end Xe. That is, the controller 50 may determine whether the target discharge position Xt is a position rearward Xr of the loading range rear end Xe. When the target discharge position Xt has not reached the loading range rear end Xe, the discharge position calculator 60 calculates the next target discharge position Xt. When the target discharge position Xt reaches the loading range rear end Xe, the controller 50 ends the loading work of the load S into the container 13.

The load discharge system 1 is only required to have a function of calculating the target discharge position Xt, and is not required to have a function of discharging the load S to the target discharge position Xt. For example, the load discharge system 1 may be used for simulation of discharge of the load S from the bucket 25*c* into the container 13. The information set in the in-bucket load information setting unit 51, the container position setting unit 53, and the loaded object position setting unit 55 illustrated in FIG. 3 is not required to be information on the actual load S or the container 13, and may be information in simulation.

In the load discharge system 1 according to the present embodiment, the target discharge position Xt is calculated on the basis of the amount of the in-bucket load Sb illustrated in FIG. 5. The reason for the above is as follows. For example, when the target discharge position Xt is shifted rearward Xr (for example, shifted at equal intervals) every time the load S is discharged from the bucket 25*c* not on the basis of the amount of the in-bucket load Sb, the height of the load S loaded into the container 13 changes depending on the amount of the in-bucket load Sb. In this case, there is a possibility that the shape (packaged appearance) of the load S in the container 13 has large irregularities. Leveling work of leveling the load S, performed after completion of the load S into the container 13, is difficult and takes time. There is also a possibility that the packaged appearance of the container 13 after the leveling work has a shape with many irregularities left.

Meanwhile, in the load discharge system 1 (see FIG. 3) according to the present embodiment, the target discharge position Xt is calculated on the basis of the mass of the in-bucket load Sb. Therefore, the load S can be loaded at as uniform a height as possible. For example, the load S can be loaded at as uniform a height as possible over the entire container 13 in the container longitudinal direction X. As a result, for example, the packaged appearance of the container 13 at the time of completion of the loading work is improved. For example, the leveling work, performed after the loading work is completed, can be easily performed when. Accordingly, the leveling work can be efficiently performed, the time of the leveling work can be shortened, and the regular feature of the packaged appearance of the container 13 after the leveling work (flatness of the load S) can be improved.

A case will be described where the angle of the bucket 25*c* with respect to the ground surface is changed while moving the bucket 25*c* from the loading range front end X0 to the loading range rear end Xe, and the load S is thus discharged from the bucket 25*c* into the container 13. In this case, it is necessary to move the bucket 25*c* in the container longitudinal direction X every time the load S is discharged from the bucket 25*c* into the container 13. Therefore, the operation of discharging the load S from the bucket 25*c* takes time, and the efficiency of the loading work is poor. In this case, in order to flatten the load S in the container 13, it is necessary to finely adjust the opening degree of the bucket 25*c* (the angle of the bucket 25*c* with respect to the ground surface or the arm 25*b*) in accordance with the amount of the load S falling from the bucket 25*c*. It is therefore difficult to control the bucket 25*c*.

Meanwhile, in the load discharge system 1 according to the present embodiment, every time the load S is discharged from the bucket 25*c*, the target discharge position Xt is shifted rearward Xr (except for the initial loading). Therefore, the load S is only required to be discharged from the bucket 25*c* into the container 13 in a state where the bucket 25*c* is disposed above (directly above or substantially directly above) the target discharge position Xt. Accordingly, the bucket 25*c* can be easily controlled. When the load S is discharged from the bucket 25*c*, the bucket 25*c* is not required to be moved greatly in the container longitudinal direction X.

[First Invention]

The load discharge system 1 according to the present embodiment is used for loading work in which the discharge operation of discharging the load S in the bucket 25*c* of the work machine 20 into the container 13 is repeatedly performed. The load discharge system 1 includes the in-bucket load information setting unit 51, the container position setting unit 53, and the discharge position calculator 60. The in-bucket load information setting unit 51 acquires information on the amount of the in-bucket load Sb which is the load S in the bucket 25*c* of the work machine 20. The container position setting unit 53 acquires information on the position of the container 13.

The discharge position calculator 60 of the controller 50 calculates the target discharge position Xt that is a target position for the discharge operation by using the information on the position of the container 13 and the information on the amount of the in-bucket load Sb.

The height of the next discharge load Sc formed in the container 13 when the load S is discharged into the container 13 changes in accordance with the amount of the load S in the bucket 25*c*. In a first invention, the controller 50 calculates the target discharge position Xt by using the information on the position of the container 13 and the information on the amount of the in-bucket load Sb. In the first invention, the target discharge position Xt of the load S can be determined such that the height of the load S after completion of the loading work of the load S into the container 13 is as uniform as possible. As a result, the load S can be loaded into the container 13 at a uniform height.

[Second Invention]

The information on the amount of the in-bucket load Sb includes information on the mass of the in-bucket load Sb. In a second invention, the controller 50 can determine the target discharge position Xt by using the information on the mass of the in-bucket load Sb such that the height of the load S loaded into the container 13 in the loading work is as uniform as possible.

[Third Invention]

The discharge position calculator 60 of the controller 50 may calculate the target discharge position Xt such that the distance between one end of the container 13 in the container longitudinal direction X and the target discharge position Xt for the next discharge operation increases as the amount of the loaded object Sa in the container 13 increases, the loaded object Sa being formed by the load loaded into the container 13 by performing the discharge operation at least once. The discharge position calculator 60 of the controller 50 may calculate the target discharge position Xt such that the distance Lt (see FIG. 5) between the loading range front end X0 set near one end of the container 13 in the container longitudinal direction X and the target discharge position Xt for the next discharge operation increases as the amount of the loaded object Sa increases.

In a third invention, the target discharge position Xt is set so as to gradually move away from the one end of the container 13 or the loading range front end X0 as the loading work of the load S into the container 13 progresses. Therefore, the load S (next discharge load Sc) discharged from the bucket 25*c* in the next discharge operation can be loaded, for example, at a position shifted rearward Xr of the loaded object Sa. In this case, the controller 50 preferably determines the target discharge position Xt such that an end (for example, the front end) of the next discharge load Sc overlaps the end Sal (for example, the rear end) of the loaded object Sa. In this case, since the end (for example, the front end) of the next discharge load Sc can lean against the end Sal (for example, the rear end) of the loaded object Sa, the next discharge load Sc is prevented from spreading excessively forward Xf. It is therefore possible to suppress an increase in variation in height of the next discharge load Sc.

[Fourth Invention]

The discharge position calculator 60 of the controller 50 calculates the target discharge position Xt for the next discharge operation such that the distance (shift amount Is) between the loaded object Sa and the target discharge position Xt for the next discharge operation increases as the amount of the in-bucket load Sb increases. The shift amount Ls is the distance in the container longitudinal direction X from the loaded object Sa to the target discharge position Xt.

As the amount (for example, mass) of the in-bucket load Sb increases, the height of the load S (next discharge load Sc) discharged from the bucket 25*c* is likely to increase. In a fourth invention, the target discharge position Xt is calculated such that the shift amount Ls increases as the amount of the in-bucket load Sb increases. Therefore, the height of the load S after the loading work of the load S into the container 13 is completed is more likely to be uniform.

[Fifth Invention]

In the discharge position calculator 60 of the controller 50, the target loading integrated amount which is a target value of the total amount of the load S to be loaded into the container 13 by repeatedly performing the discharge operation may be set. In this case, the discharge position calculator 60 may calculate a sum of a part of the amount of the loaded object Sa or all of the amount of the loaded object Sa and the amount of the in-bucket load Sb, calculate the ratio Rm of the sum and the target loading integrated amount, and calculate the target discharge position Xt for the next discharge operation by using the ratio Rm.

In a fifth invention, since the target discharge position Xt is calculated by using the ratio Rm, the height of the load S after completion of the loading work of the load S into the container 13 is more likely to be uniform.

[Sixth Invention]

The discharge position calculator 60 of the controller 50 may acquire information on the height of the loaded object Sa in the container 13, and calculate the target discharge position Xt for the next discharge operation by using the information on the height of the loaded object Sa and the information on the amount of the in-bucket load Sb.

The discharge position calculator 60 of the controller 50 may estimate the height of the load S (next discharge load Sc) discharged from the bucket 25*c* when the in-bucket load Sb is assumed to be discharged to a position shifted from the loaded object Sa by the predetermined shift amount Ls. The discharge position calculator 60 may calculate the target discharge position Xt by using the estimated height of the load S (next discharge load Sc) and the shift amount Ls.

In a sixth invention, the discharge position calculator 60 can calculate the target discharge position Xt even if the target loading integrated amount is not set. Therefore, the setting of the target loading integrated amount can be omitted.

[Seventh Invention]

The discharge position calculator 60 of the controller 50 may calculate the target discharge position Xt for the discharge operation at the same position such that the discharge operation is performed at the same position a plurality of times from a start of the loading work until a preset initial loading end condition is satisfied. The initial loading end condition is a condition set in the controller 50.

At the start of the loading work, no or almost no load S is loaded into the container 13. Therefore, the load S that has been discharged from the bucket 25*c* and has fallen on the bottom surface 13*a* of the container 13 at the start of the loading work tends to easily spread outward in the horizontal direction from the position of the fall and is less likely to be stacked upward. This is because there is no other load S (that is, no loaded object) near the load S having fallen on the bottom surface 13*a* at the start of the loading work, and thus there is no loaded object Sa nearby against which the load S having fallen on the bottom surface 13*a* can lean at the start of the loading work. In a seventh invention, the target discharge position Xt is set such that the discharge operation is performed a plurality of times at the same position from the start of the loading work until the initial loading end condition is satisfied. Therefore, the height of the load S (initial load Si) discharged at the start of the loading work can be prevented from becoming lower than the height of the load S to be loaded thereafter. As a result, the height of the load S after the loading work of the load S into the container 13 is completed is more likely to be uniform.

[Eighth Invention]

The initial loading end condition may include at least one of a fact that the number of times of the discharge operation at the same position has reached a preset value, a fact that a total amount of the load loaded into the container 13 by the discharge operation at the same position has exceeded a preset value, or a fact that a height of a deposit formed by the load loaded into the container 13 by the discharge operation at the same position has exceeded a preset value.

In an eighth invention, the controller 50 can appropriately determine whether to end the initial loading.

[Ninth Invention]

The load discharge system 1 may further include a drive control unit 27 that controls an operation of the plurality of actuators including the actuator that moves the bucket 25*c*. In this case, the controller 50 outputs a command for performing the discharge operation according to the target discharge position Xt to the drive control unit 27.

In a ninth invention, the load S can be loaded into the container 13 such that the height of the load S after completion of the loading work of the load S into the container 13 is as uniform as possible.

Modifications

The above embodiment may be variously modified. For example, the connection between the components of the above embodiment illustrated in FIG. 3 may be changed. Specifically, for example, when the position of the container 13 is set by teaching, the detection value of the orientation sensor 31 may be input to the container position setting unit 53. For example, various values, ranges, and the like may be constant, may be changed by manual operation, or may be automatically changed in accordance with some condition. For example, the number of components may be changed, and some of the components need not be provided. For example, the components may be fixed or connected directly or indirectly. For example, a plurality of members and parts different from each other may be described as one member and part. For example, what has been described as one member and part may be divided into a plurality of different members and parts. Specifically, for example, the controller 50 may be divided into a plurality of parts. More specifically, the in-bucket load information setting unit 51 and the discharge position calculator 60 may be separately provided. For example, the components each may have only some of the characteristics (function, arrangement, shape, operation, and the like).

The invention claimed is:

1. A load discharge system used for a loading work in which a discharge operation of loading a load in a bucket of a work machine into a container is repeatedly performed, the load discharge system comprising:

a controller configured to:

acquire information on an amount of the load in the bucket of the work machine;

acquire information on a position of the container; and calculate a target discharge position that is a target position for the discharge operation by using the information on the position of the container and the information on the amount of the load in the bucket, wherein the controller is configured to calculate the target discharge position for the next discharge operation according to a condition that a distance between one end of the container in a container longitudinal direction and the target discharge position for the next discharge operation increases as an amount of a loaded object in the container increases, the loaded object being formed by the load loaded into the container by performing the discharge operation at least once.

2. The load discharge system according to claim 1, wherein the information on the amount of the load in the bucket includes information on a mass of the load in the bucket.

3. The load discharge system according to claim 1, further comprising a drive control unit that controls an operation of a plurality of actuators including an actuator that moves the bucket, wherein the controller outputs, to the drive control unit, a command for performing the discharge operation according to the target discharge position.

4. A load discharge system used for a loading work in which a discharge operation of loading a load in a bucket of a work machine into a container is repeatedly performed, the load discharge system comprising:

a controller configured to:

acquire information on an amount of the load in the bucket of the work machine;

acquire information on a position of the container;

calculate a target discharge position that is a target position for the discharge operation by using the information on the position of the container and the information on the amount of the load in the bucket; and calculate the target discharge position for the next discharge operation according to a condition that as the amount of the load in the bucket increases, a distance between the target discharge position for the next discharge operation and a loaded object in the container increases, the loaded object being formed by the load loaded into the container by performing the discharge operation at least once.

5. The load discharge system according to claim 4, wherein a target loading integrated amount that is a target value of a total amount of the load to be loaded into the container by repeatedly performing the discharge operation is set in the controller, and the controller calculates a sum of the amount of the load in the bucket and an amount of a part or all of the loaded object that is in the container and is formed by the load loaded into the container by performing the discharge operation at least once, calculates a ratio of the sum and the target loading integrated amount, and calculates the target discharge position for the next discharge operation by using the ratio.

6. The load discharge system according to claim 1, wherein the controller acquires information on a height of the loaded object in the container and is formed by the load loaded into the container by performing the discharge operation at least once, and calculates the target discharge position for the next discharge operation by using the information on the height of the loaded object and the information on the amount of the load in the bucket.

7. A load discharge system used for a loading work in which a discharge operation of loading a load in a bucket of a work machine into a container is repeatedly performed, the load discharge system comprising:

a controller configured to:

acquire information on an amount of the load in the bucket of the work machine;

acquire information on a position of the container, and calculates a target discharge position that is a target position for the discharge operation by using the information on the position of the container and the information on the amount of the load in the bucket; and calculate the target discharge position for the discharge operation at a same position according to a condition that the discharge operation is performed at a same position a plurality of times from a start of the loading work until an initial loading end condition set in advance is satisfied, wherein the initial loading end condition includes at least one of a fact that a number of times of the discharge operation at the same position has reached a preset value, a fact that a total amount of the load loaded into the container by the discharge operation at the same position has exceeded a preset value, or a fact that a height of a deposit formed by the load loaded into the container by the discharge operation at the same position has exceeded a preset value.

* * * * *